US007013902B2

(12) United States Patent
Stout et al.

(10) Patent No.: US 7,013,902 B2
(45) Date of Patent: Mar. 21, 2006

(54) WET CLEANING MOBILE WORKBENCH

(75) Inventors: Christopher A. Stout, Bremerton, WA (US); Alan R. Lappen, San Martin, CA (US)

(73) Assignee: Applied Materials, Inc., Santa Clara, CA (US)

( * ) Notice: Subject to any disclaimer, the term of this patent is extended or adjusted under 35 U.S.C. 154(b) by 213 days.

(21) Appl. No.: 10/360,273

(22) Filed: Feb. 7, 2003

(65) Prior Publication Data

US 2004/0154648 A1 Aug. 12, 2004

(51) Int. Cl.
*B08B 3/04* (2006.01)
*B08B 5/04* (2006.01)

(52) U.S. Cl. ..... 134/104.2; 134/117; 134/123

(58) Field of Classification Search ..... 134/85, 134/104.2, 117, 123; 15/DIG. 2
See application file for complete search history.

(56) References Cited

U.S. PATENT DOCUMENTS

| | | | | |
|---|---|---|---|---|
| 3,041,957 | A | | 7/1962 | Liptay |
| 3,594,830 | A | | 7/1971 | Clifton |
| 4,016,809 | A | | 4/1977 | Austin |
| 4,130,123 | A | | 12/1978 | Wines, Jr. et al. |
| 4,418,969 | A | | 12/1983 | Hettman |
| 4,440,185 | A | | 4/1984 | Wiltse |
| 4,557,184 | A | | 12/1985 | Orii et al. |
| 4,928,440 | A | | 5/1990 | Hughes |
| 4,971,083 | A | | 11/1990 | Stach et al. |
| 4,993,199 | A | | 2/1991 | Hughes |
| 4,996,910 | A | | 3/1991 | Howorth |
| 5,095,925 | A | | 3/1992 | Elledge et al. |
| 5,219,215 | A | | 6/1993 | Akagawa et al. |
| 5,257,957 | A | | 11/1993 | Diccianni et al. |
| 5,401,328 | A | | 3/1995 | Schmitz |
| 5,441,708 | A | | 8/1995 | Diccianni et al. |
| 5,526,539 | A | | 6/1996 | Bower et al. |
| 5,535,766 | A | * | 7/1996 | Edwards ..... 134/60 |
| 5,577,817 | A | | 11/1996 | Reynolds |
| 5,669,401 | A | * | 9/1997 | Mansur ..... 134/108 |
| 6,029,718 | A | | 2/2000 | Jackson et al. |
| 6,058,947 | A | * | 5/2000 | Bennett et al. ..... 134/113 |
| 6,101,643 | A | * | 8/2000 | Moore ..... 4/631 |
| 6,162,118 | A | | 12/2000 | Arts et al. |
| 6,173,458 | B1 | | 1/2001 | Maddux |
| 6,427,259 | B1 | | 8/2002 | Cawthon |
| 2002/0020837 | A1 | | 2/2002 | Sherwin |

FOREIGN PATENT DOCUMENTS

| | | |
|---|---|---|
| DE | 2155298 | 5/1973 |
| JP | 62158933 | 7/1987 |
| JP | 3137443 | 6/1991 |
| JP | 4075883 | 3/1992 |
| JP | 9155209 | 6/1997 |
| JP | 2001141273 | 5/2001 |

* cited by examiner

*Primary Examiner*—Michael Barr
*Assistant Examiner*—Saeed Chaudhry
(74) *Attorney, Agent, or Firm*—Konrad, Raynes & Victor, LLP

(57) ABSTRACT

A mobile cleaning workbench that may be used for manually washing equipment components, parts or other articles is provided. The cleaning station provides a source of water or other cleaning liquid for use in the washing of an article in a wash basin. A drain is provided for removal of cleaning liquid from the wash basin. Since some chemicals produce vapors which are emitted as chemical-laden articles are moved about, alternative embodiments of the invention include a ventilation exhaust system that removes the vapors from the washing area and transfers them to a remote location via appropriate ducting.

6 Claims, 3 Drawing Sheets

WET CLEANING MOBILE WORKBENCH

FIELD OF THE INVENTION

This invention relates to equipment for the washing of components or parts which are used in semiconductor manufacturing facilities.

BACKGROUND

In many manufacturing or other industrial facility environments, it is desirable to wash equipment components, parts or other articles. In some facilities, the articles are coated with acids, bases or other chemicals which should be removed and which pose facility contamination or personnel hazard problems if those chemicals are dispersed from the articles. Additionally, some of these chemicals can be the source of unpleasant odors.

Cleaning stations located in industrial facilities have been used for removing chemicals from equipment components, parts or other articles. However in many industrial environments, it is necessary to remove the component from its equipment and transport the component some distance to the cleaning station. As a consequence facility contamination or odor problems can be spread.

SUMMARY OF THE ILLUSTRATED EMBODIMENTS

A mobile cleaning station for washing articles and for use with a facility having a facility liquid supply conduit and a facility liquid removal conduit is provided. The cleaning station comprises a carriage and a plurality of wheels rotatably mounted to the carriage to facilitate rolling movement of the carriage. A basin is supported by the carriage and is adapted to hold a liquid for use in manually washing the articles. A carriage supply conduit is adapted for detachable connection to the facility liquid supply conduit and for providing a liquid flow path into the basin. A carriage removal conduit is adapted for detachable connection to the facility liquid removal conduit for providing a liquid drain or flow path from the basin. A brake mechanism is attached to the carriage and is adapted to resist the rolling movement of the carriage.

In one aspect, the basin has a bottom wall and at least one side wall defining an upper opening. The mobile cleaning station further comprises a ventilation conduit and a ventilation enclosure having an interior area. The ventilation enclosure is supported by the carriage and is adapted to at least partially enclose the basin upper opening. The ventilation conduit defines a gas intake opening in fluid communication with the basin upper opening and with the ventilation enclosure interior area. The ventilation conduit is adapted to provide a gas flow path from the ventilation enclosure interior area into the gas intake opening and through the ventilation conduit.

In another aspect, the mobile cleaning station further comprises a slidable storage compartment or drawer supported by the carriage. The compartment is adapted for holding tools or parts.

In yet another aspect, the mobile cleaning station comprises a frame and a plurality of panels attached to the frame and at least partially enclosing the frame. The panels are constructed of plastic.

In an alternative embodiment, the mobile cleaning station comprises a carriage and a plurality of wheels rotatably mounted to the carriage to facilitate rolling movement of the carriage. A basin adapted to hold a liquid for use in manually washing the articles is supported by the carriage. The basin has a bottom wall and at least one side wall which defines an upper opening. The cleaning station further comprises a carriage supply conduit which is adapted for providing a liquid flow path into the basin, a carriage removal conduit which is adapted for providing a liquid flow path from the basin, and a ventilation enclosure having an interior area and which is adapted for detachable connection to the carriage and for at least partially enclosing the basin upper opening. Finally, a ventilation conduit is adapted for detachable connection to the carriage. The ventilation conduit defines a gas intake opening in fluid communication with the basin upper opening and with the interior area of the ventilation enclosure. The ventilation conduit is adapted to provide a gas flow path from the ventilation enclosure interior area into the gas intake opening and through the ventilation conduit.

In yet another embodiment, a method of washing an article with a facility having a facility liquid supply conduit, a facility liquid removal conduit, and a facility gas removal conduit is provided. A carriage having a plurality of wheels rotatably mounted to the carriage is rolled to a location at the facility. A carriage supply conduit is attached to the facility liquid supply conduit. The carriage supply conduit is adapted to provide a liquid flow path into a basin which is supported by the carriage and adapted to hold a liquid for use in manually washing the article. The basin has a bottom wall and at least one side wall defining a basin upper opening.

A carriage removal conduit adapted for providing a liquid flow path from the basin is attached to the facility liquid removal conduit. A ventilation conduit is attached to the facility gas removal conduit. The ventilation conduit defines a gas intake opening which is in fluid communication with the basin upper opening and with the interior area of a ventilation enclosure. The ventilation enclosure is supported by the carriage and is adapted to at least partially enclose the basin upper opening.

The article is wetted with the liquid flowing from the carriage supply conduit into the basin. The liquid is removed from the basin with the carriage removal conduit. Finally, a gas is removed from the ventilation enclosure interior area into the gas intake opening and through the ventilation conduit.

There are additional aspects to the present inventions. It should therefore be understood that the preceding is merely a brief summary of some embodiments and aspects of the present inventions. Additional embodiments and aspects of the present inventions are referenced below. It should further be understood that numerous changes to the disclosed embodiments can be made without departing from the spirit or scope of the inventions. The preceding summary therefore is not meant to limit the scope of the inventions. Rather, the scope of the inventions is to be determined by appended claims and their equivalents.

DETAILED DESCRIPTION OF THE PREFERRED EMBODIMENTS

Figure 2:
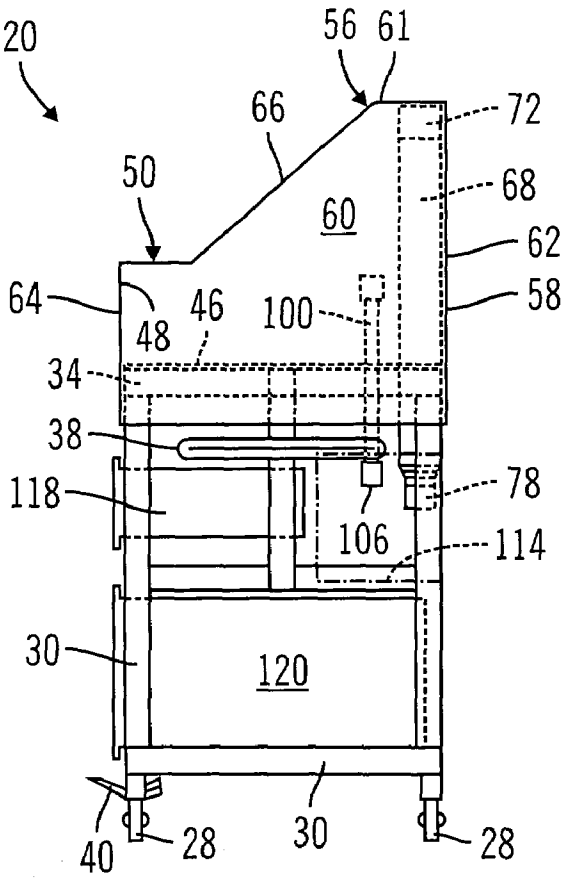
FIG. 2 is a side elevation view of the mobile cleaning station of FIG. 1 with a lower panel removed.

In the following description, reference is made to the accompanying drawings which form a part hereof and which illustrate several embodiments of the present invention. It is understood that other embodiments may be utilized and structural and operational changes may be made without departing from the scope of the present invention.

There is disclosed a mobile cleaning workbench or station that may be used for manually washing equipment components, parts or other articles. It is of particular use by an operator in a semiconductor manufacturing facility. In one embodiment, the station permits most, if not all, of the washing facilities to be in a compact, mobile unit for movement to and from various equipment locations, such as for example, in proximity to plasma etchers, physical vapor deposition chambers, chemical vapor deposition chambers, etc.

The cleaning station provides a source of water or other cleaning liquid for use in the washing of an article in a wash basin. Moreover a drain is provided for removal of the contaminated cleaning liquid from the wash basin. Since some chemicals produce vapors which are emitted as the chemical-laden articles are moved about, alternative embodiments of the invention include a ventilation exhaust conduit that removes the vapor from the washing area and transfers it to a remote location via appropriate ducting.

Referring now to FIGS. 1–4, one embodiment of the invention is a mobile cleaning station 20 for use with a manufacturing facility having certain installed utilities 21 which are external to the cleaning station 20. These external utilities 21 include a liquid or water supply line 23 which is installed in the vicinity of certain of the manufacturing equipment. Similarly the utilities 21 include a liquid or water drain line 25 and a ventilation exhaust or vacuum conduit 27, both of which also are installed in the vicinity of this manufacturing equipment.

The mobile cleaning station 20 includes a carriage 22 comprised of a metal frame 24. The frame 24 has a central box-shaped portion 30 and two outwardly extending upper portions 32, 34 which are attached to and disposed on opposite sides of the central portion 30. Secured to each of the frame upper portions 32, 24 are handles 36, 38 which allow an operator to conveniently grasp the cleaning station 20 in order to more easily move it.

The carriage 22 is further comprised of a plurality of panels 26 which are attached to and enclose the frame 24. In one embodiment, the panels 26 are constructed of ¼ inch PVC plastic in order to provide protection from and resistance to the corrosive acids and bases which may be present on the articles which are to be cleaned.

Four castor wheels 28 are rotatably mounted to the central portion 30 of the frame 24 to facilitate the rolling movement of the cleaning station 20. While the swivel action of the castor wheels 28 may assist in the movement of the station 20, it should be appreciated that other types of wheels may be used in alternative embodiments of the inventions. A brake mechanism 40 adapted to resist the rolling movement of the cleaning station 20 is attached to the bottom of the central portion 30 of the frame 24 at the front end of the cleaning station 20. The illustrated brake mechanism 40 is a foot-operated, friction brake having a bottom friction plate 42 which can be pushed against the floor of the facility to resist the rolling movement of the cleaning station 20. However, other embodiments of the inventions may include alternative kinds of brake mechanisms, such as lock or friction mechanisms which are attached directly to the wheels to resist the rolling movement of the wheels themselves. Alternatively, a fulcrum brake assembly which slightly lifts the frame 24 off of the wheels 28 may be used.

Figure 4:
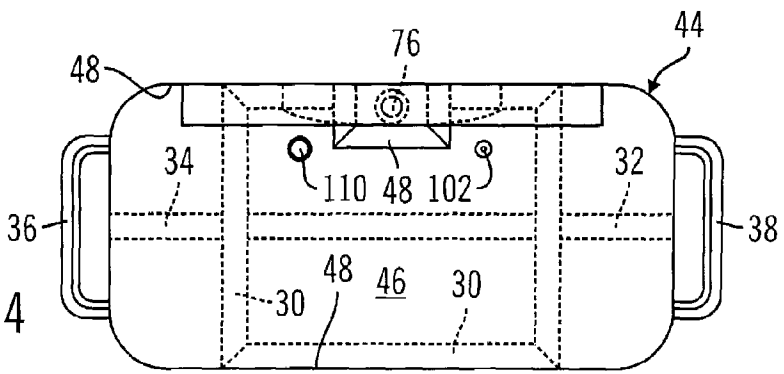
FIG. 4 is a top plan view of the basin assembly of the mobile cleaning station of FIG. 1 with the top panel removed.

A basin assembly 44 sits atop and is supported by the central portion 30 and the outer portions 32, 34 of the frame 24. As best seen in FIG. 4, the basin assembly 44 includes a bottom floor or wall 46 and a plurality of side walls 48 which define an upper basin opening 50 (FIG. 2). In the illustrated embodiment, the basin assembly 44 is adapted to hold a liquid having a depth of approximately 7 inches in order to facilitate the manual washing of articles by an operator. However, other embodiments may employ basins which can hold liquids of more or less depth.

A ventilation hood or enclosure 56 is supported by the central portion 30 and the outer portions 32, 34 of the frame 24, and is adapted to partially enclose the upper opening 50 of the basin assembly 44. The enclosure 56 is U-shaped and has an interior area 57 defined by a rectangular-shaped rear panel 58 extending vertically upward from the rear of the basin assembly 44, and two side panels 60 extending vertically upward from both ledges 52, 54 of the basin assembly 44. A horizontally oriented top panel 61 connects the two side panels 60 and the rear panel 58.

As best seen in FIG. 2, each of the side panels 60 has a distal edge 62, a proximate edge 64 and a top edge 66. The distal edge 62 extends vertically to the top panel 61 and is the same height as the rear panel 58. The proximate edge 64 extends vertically to approximately 50% of the height of the distal edge 62 and is connected to the distal edge 62 by the top edge 66 which is tapered from the distal edge 62 to the proximate edge 64. This tapered geometry of the side panels 60 permits convenient access by an operator to the basin area while providing a splash guard around the basin upper opening 50 and a partial enclosure of the air space in the interior area 57 located above the basin upper opening 50 to aid in confining any gases which may be emitted by chemicals on the articles being washed in the basin.

A ventilation conduit 68 is disposed in the interior area 57 of the ventilation enclosure 56 where the conduit 68 abuts both the ventilation enclosure rear panel 58 and top panel 61. The conduit 68 defines a gas intake opening 70 which is in fluid communication with the basin upper opening 50 and with the ventilation enclosure interior area 57. The intake opening 70 leads to a rectangular-shaped chamber 72, both of which are disposed at the upper-most portion of the ventilation enclosure 56, adjacent to the top panel 61. The chamber 72 portion of the conduit 68 tapers downwardly to a cylindrically-shaped lower portion 74 which in turn extends through a ventilation opening 76 in the basin assembly 44 (FIG. 4) and terminates with a ventilation duct fitting 78 below the basin assembly. (FIG. 2)

The fitting 78 is adapted for detachable connection to the facility gas removal conduit or suction line 27. The facility suction line 27 may be connected to blowers or other machinery which are located in remote areas of the facility and which are capable of providing a suction force to draw gases from the area of the basin assembly 44 through the ventilation conduit 68 and into the facility suction line 27. The facility suction line 27 may then transport the gases to the outside of the facility or, if necessary, to filters.

The intake opening 70 of the conduit 68 has a horizontally-oriented hourglass shape with the narrow portion disposed in alignment with the centerline 71 of the conduit lower portion 74. Because the suction force is believed to be greatest at the center of the ventilation conduit 68 which is in alignment with the lower portion 74, the relatively narrow portion of the opening 70 may restrict the incoming gas flow. This may offset the relatively lower suction force located at the wider, outer ends of the opening 70, which in turn, may equalize the "draw" of the gas over the width of the conduit opening 70.

Figure 5B:
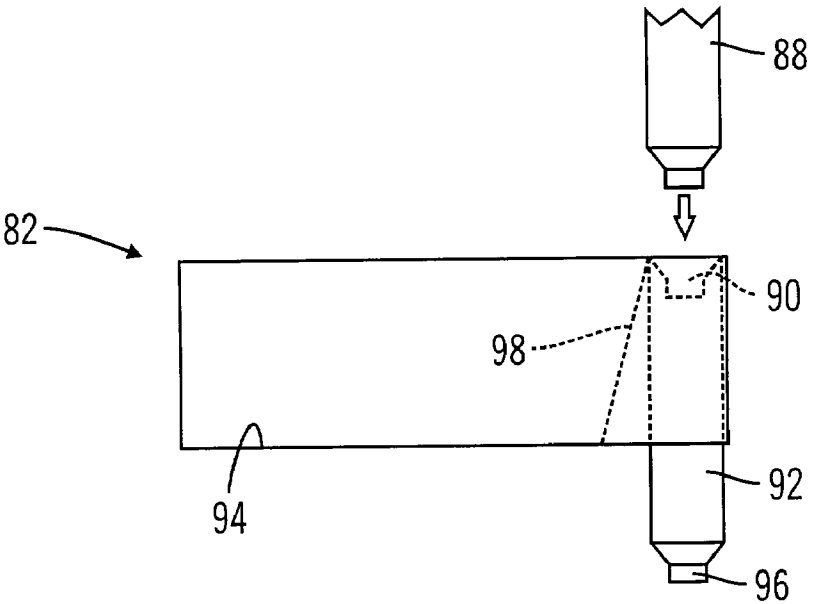
FIG. 5B is a side elevation view of an alternative embodiment of a mobile cleaning station ventilation conduit and basin assembly.
Figure 5A:
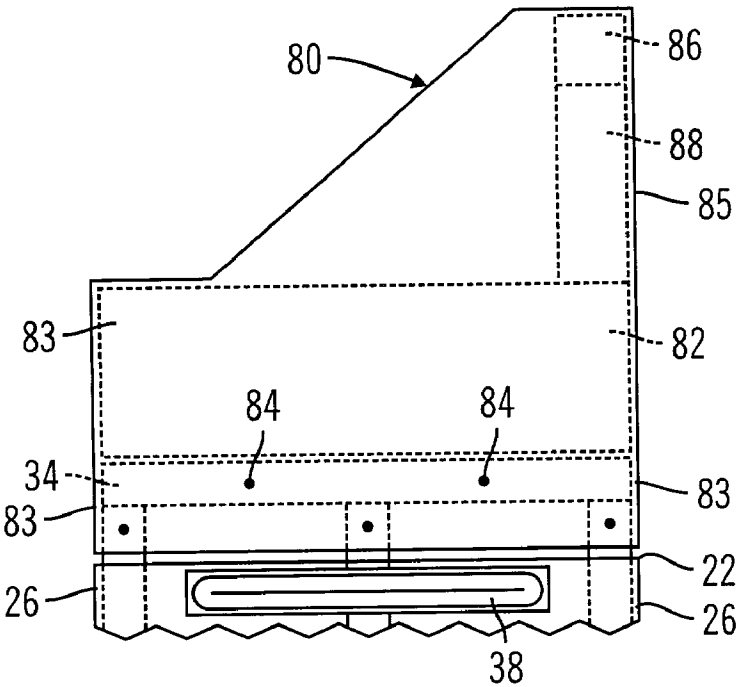
FIG. 5A is a side elevation view of an alternative embodiment of a mobile cleaning station ventilation enclosure.

In the embodiment of FIGS. 1–4, the ventilation enclosure 56 and ventilation conduit 68 are welded to the basin assembly 44 and form an integrated component which is permanently secured to the cleaning station 20. In FIGS. 5A and 5B, an alternative embodiment of a ventilation enclosure 80 and ventilation conduit 86 are shown, both of which are adapted for detachable connection to the carriage 22.

The basin assembly 82, ventilation conduit 86 and the ventilation enclosure 80 are separate components which are not permanently connected to one another. The basin assembly 82 is welded or otherwise permanently secured to the carriage frame. The side panels 83 (only one of which is shown in FIG. 5A) and rear panel 85 of the ventilation enclosure 80 surround three of the four sides of the basin assembly 82. A plurality of bolts 84 or other fasteners may be used to secure the lower portion of the enclosure 80 to the upper frame portions 32, 34 and central frame portion 30. When it is desired to remove the enclosure 80, the bolts 84 can be removed and the enclosure 80 lifted off of the carriage.

The ventilation conduit 86 is positioned inside the enclosure 80 abutting the enclosure rear panel 85. The cylindrically-shaped lower portion 88 of the conduit 86 is sized for insertion into a conduit fitting 90 in the basin assembly 82. The basin assembly 82 further includes a secondary exhaust conduit 92 which is in fluid communication with the conduit fitting 90 and which extends below the basin bottom wall 94 and terminates with a ventilation duct fitting 96 which is adapted for detachable connection to a facility gas removal conduit or suction line. An interior basin side wall 98 provides a liquid tight barrier between the portion of the basin assembly 82 which holds the liquid used for washing the articles, on the one hand, and the conduit fitting 90 and secondary conduit 92, on the other hand.

Referring again to FIGS. 1–4, a carriage supply conduit 100 for providing a liquid flow path of a liquid, such as water, into the basin is shown. The supply conduit 100 extends vertically through a supply opening 102 in the bottom wall 46 of the basin assembly 44. (FIG. 4) The conduit 100 has an upper fitting 104 adapted for attachment to a faucet or to flexible tubing leading to a spray nozzle, either of which may be used to fill the basin with water or other liquid and to spray the article being cleaned with the washing liquid. The supply conduit 100 further extends below the basin assembly 44 and is adapted for detachable connection to the facility liquid or water supply conduit 23 by a lower fitting 106 or coupler which is disposed below the basin assembly 44.

A drain conduit 108 for providing a liquid flow or drain path from the basin is attached to a drain opening 110 in the bottom wall 46 of the basin assembly 44. The drain conduit 108 extends vertically below the basin assembly 44 and is adapted for detachable connection to a facility liquid removal conduit, or drain line, by a lower drain fitting 112 or coupler. The drain opening 110 is sized to receive a plug or stopper for use when it is desired that a liquid having a certain depth be provided for washing the articles.

Figure 3:
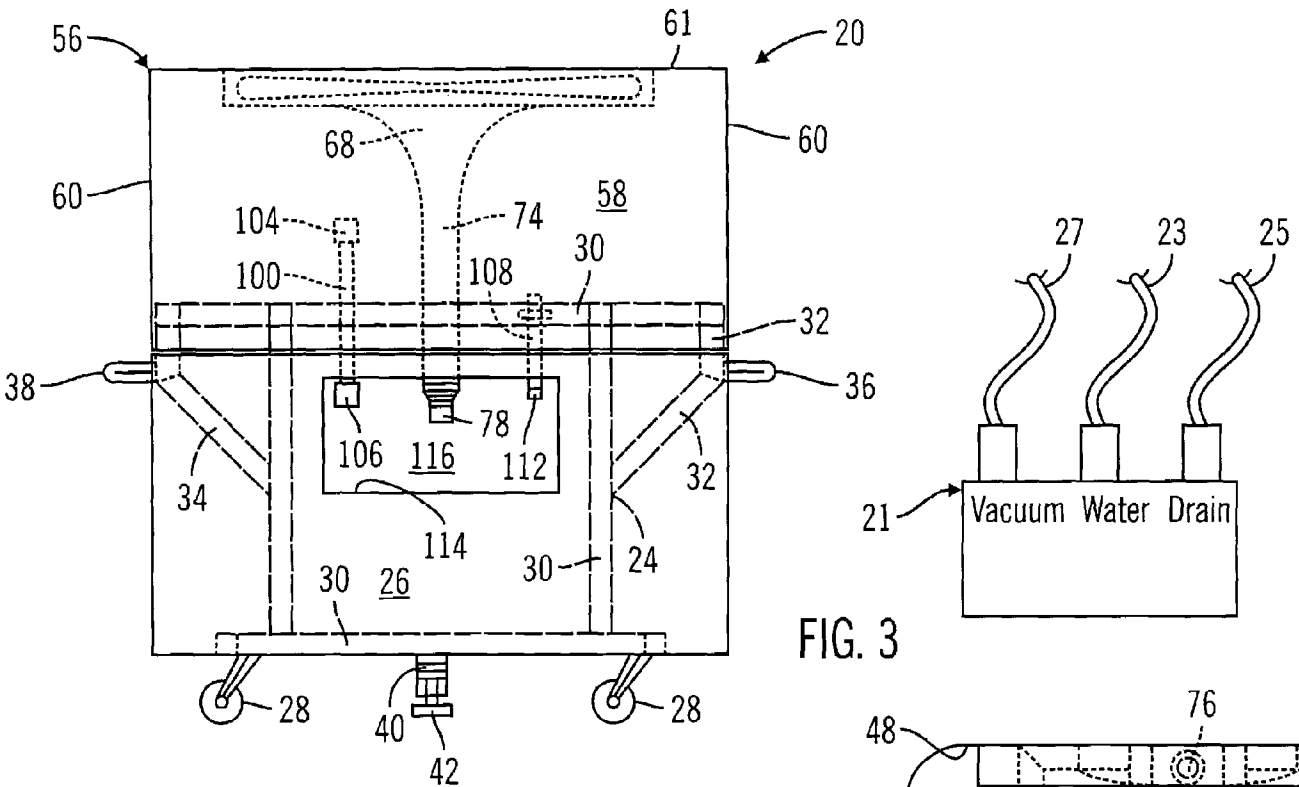
FIG. 3 is rear elevation view of the mobile cleaning station of FIG. 1.

Referring to FIGS. 2 and 3, a rear access box 114 having an opening 116 which is accessible from the rear of the cleaning station 20 is secured to the frame 24. Except for the opening 116, the access box 114 is watertight in construction and is adapted to permit the ventilation, drain and supply conduits 68, 100, 108 to extend into and terminate in the box 114. The box 114 is sized to permit easy manual access to the lower drain fitting 112, the lower supply fitting 106 and the ventilation duct fitting 78 by an operator for attaching or detaching, as the case may be, to the facility utilities, i.e., the facility supply, drain and exhaust lines, to the corresponding cleaning station 20 conduits. Any leakage which may occur at these fittings may be more easily contained or controlled by the watertight construction of the access box 114.

Figure 1:
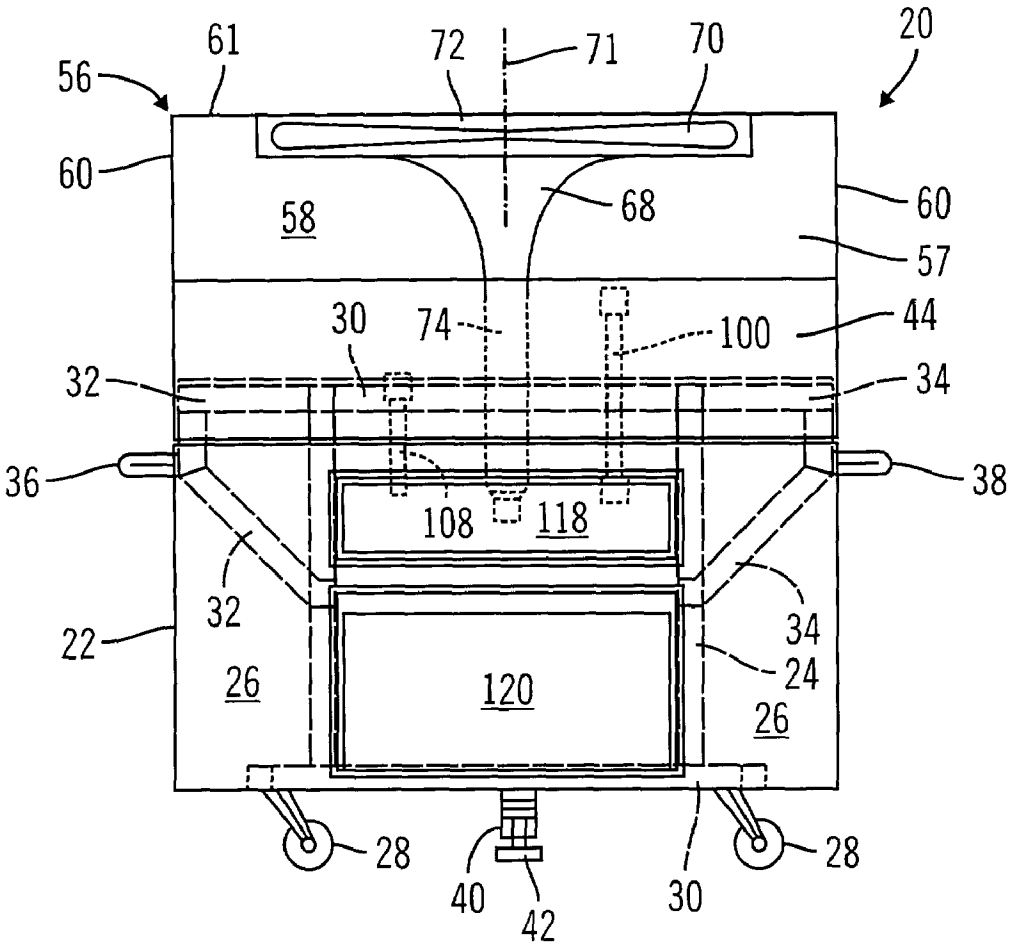
FIG. 1 is a front elevation view of a mobile cleaning station in accordance with one embodiment of the claimed invention.

As best seen in FIGS. 1 and 2, a slidable tool storage drawer 118 is supported by the frame 24 and disposed below the basin assembly 44. The drawer 118 is mounted on rail slide assemblies which permit easy opening and closing of the drawer 118 by the operator while standing adjacent to the basin assembly 44. The drawer 118 is adapted for holding small parts or tools which may be useful in the disassembly of parts during the course of their washing. Below the tool drawer 118 is disposed a slidable parts storage drawer 120 which also is supported by the frame 24. The parts storage drawer 120 is larger than the tool drawer 118 and is adapted for holding items such as the articles or machinery parts which have been washed in order to permit convenient transportation of the washed articles to another location.

In operation, the operator rolls the carriage 22 to a first location at the facility in proximity to equipment having a component that is to be removed and washed. By pressing down on the brake mechanism 40 with his or her foot, the operator causes the friction plate 42 of the brake mechanism 40 to press against the floor thus resisting the rolling movement of the carriage 22. The operator then attaches the carriage liquid supply conduit 100 to a facility liquid supply conduit, the carriage removal conduit 108 to a facility liquid removal conduit, and the ventilation conduit 68 to a facility gas removal conduit.

Next an article or component which has been removed from the equipment is taken and washed with a liquid, such as water, flowing from the facility liquid supply conduit, through the carriage supply conduit 100 and into the basin 44. After the washing is completed or during the course of washing, the liquid is removed from the basin via the carriage removal conduit 108 or drain line and the facility liquid removal conduit. Much of the gas emitted by the chemicals on the article being washed is removed from the ventilation enclosure interior area 57 into the gas intake opening 70 and through the ventilation conduit 68 by the suction force provided by the facility gas removal conduit.

The washed article is placed in the parts storage drawer 120 for transportation to another location within the facility. After all articles originating in this first location are washed, the carriage liquid supply conduit 100, the carriage removal conduit 108, and the ventilation conduit 68 are detached from the corresponding facility utility lines. The operator then presses down on the brake mechanism 40 with his or her foot a second time to release the friction plate 42 from contact against the floor. The carriage is then rolled to another location in the facility.

Thus the mobile cleaning station provides a source of water or other cleaning liquid for use in the washing of an article in a wash basin. Moreover a drain is provided for removal of contaminated cleaning liquid from the wash basin. Since some chemicals produce vapors or gases which are emitted as chemical-laden articles are moved about, a ventilation exhaust conduit removes gas from the washing area and is detachably connected to an external facility exhaust line or conduit which transfers the gas to a remote location.

While the description above refers to particular embodiments of the present invention, it will be understood that many modifications may be made without departing from the spirit thereof. The claims are intended to cover such modifications as would fall within the true scope and spirit of the present invention. The presently disclosed embodiments are therefore to be considered in all respects as illustrative and not restrictive, the scope of the invention being indicated by the claims rather than the foregoing description, and all changes which come within the meaning and range of equivalency of the claims are therefore intended to be embraced therein.

What is claimed is:

1. A mobile cleaning station for washing articles and for use with a facility having a facility liquid supply conduit, a facility liquid removal conduit, and a facility gas removal conduit, comprising:

a carriage;

a plurality of wheels rotatably mounted to the carriage to facilitate rolling movement of the carriage;

a basin supported by the carriage and having a bottom wall and at least one side wall defining an upper opening, the basin being adapted to hold a liquid for use in manually washing the articles;

a carriage supply conduit adapted for detachable connection to the facility liquid supply conduit and for providing a liquid flow path into the basin;

a carriage removal conduit adapted for detachable connection to the facility liquid removal conduit and for providing a liquid flow path from the basin;

a ventilation enclosure defining an interior area, the enclosure being adapted for detachable connection to the carriage and for at least partially enclosing the basin upper opening; and a ventilation conduit adapted for detachable connection to the facility gas removal conduit and for detachable connection to the carriage, the ventilation conduit defining a gas intake opening in fluid communication with the basin upper opening and with the ventilation enclosure interior area, the ventilation conduit being adapted to provide a gas flow path from the ventilation enclosure into the gas intake opening and through the ventilation conduit.

2. A mobile cleaning station for washing articles and for use with a facility having a facility liquid supply conduit and a facility liquid removal conduit, comprising:

a carriage:

a plurality of wheels rotatably mounted to the carriage to facilitate rolling movement of the carriage;

a basin supported by the carriage and having a bottom wall and at least one side wall defining an upper opening, the basin being adapted to hold a liquid for use in manually washing the articles;

a carriage supply conduit adapted for detachable connection to the facility liquid supply conduit and for providing a liquid flow path into the basin;

a carriage removal conduit adapted for detachable connection to the facility liquid removal conduit and for providing a liquid flow path from the basin;

a ventilation enclosure defining an interior area, the enclosure being supported by the carriage and adapted to at least partially enclose the basin upper opening; and a ventilation conduit defining a gas intake opening in fluid communication with the basin upper opening and with the ventilation enclosure interior area, the ventilation conduit being adapted to provide a gas flow path from the ventilation enclosure into the gas intake opening and through the ventilation conduit;

wherein the facility further has a facility gas removal conduit, and wherein the ventilation conduit is adapted for detachable connection to the facility gas removal conduit.

3. A mobile cleaning station for washing articles and for use with a facility having a facility liquid supply conduit, a facility liquid removal conduit, and a facility gas removal conduit, the mobile cleaning station comprising:

a frame;

a plurality of panels attached to the frame and at least partially enclosing the frame, said panels being constructed of plastic;

a plurality of wheels rotatably mounted to the frame to facilitate rolling movement of the frame;

a brake mechanism adapted to resist the rolling movement of the frame;

a basin supported by the frame and having a bottom wall and at least one side wall defining an upper opening, the basin being adapted to hold a liquid for use in manually washing the articles;

a carriage supply conduit adapted for detachable connection to the facility liquid supply conduit and for providing a liquid flow path into the basin;

a drain conduit adapted for detachable connection to the facility liquid removal conduit and for providing a liquid flow path from the basin;

a ventilation enclosure defining an interior area, the enclosure being supported by the frame and adapted to at least partially enclose the basin upper opening;

a ventilation conduit adapted for detachable connection to the facility gas removal conduit, the ventilation conduit defining a gas intake opening in fluid communication with the basin upper opening and with the ventilation enclosure interior area; and a slidable storage drawer supported by the frame and disposed below the basin, the slidable storage drawer being adapted for holding one of tools and parts.

4. A mobile cleaning station for washing articles and for use with a facility having a facility liquid supply conduit, a facility liquid removal conduit, and a facility gas removal conduit, the method comprising:

means for moving a carriage to a location at the facility;

means for containing a liquid on the carriage for washing the articles;

means for supplying the liquid to the liquid containing means with a carriage supply conduit adapted for detachable connection to the facility liquid supply conduit;

means for removing the liquid from the liquid containing means with a carriage removal conduit adapted for detachable connection to the facility liquid removal conduit;

means for at least partially containing a gas to an area adjacent to the liquid containing means; and means for removing the gas from the gas containing means with a ventilation conduit adapted for detachable connection to the facility gas removal conduit.

5. The mobile cleaning station of claim 4 further comprising means for resisting the movement of the carriage.

6. The mobile cleaning station of claim 4 further comprising means for storing one of tools and parts on the carriage.

* * * * *